US008827763B2

(12) United States Patent
DeBlanco et al.

(10) Patent No.: US 8,827,763 B2
(45) Date of Patent: Sep. 9, 2014

(54) MY OWN GARAGE—A FUNCTIONAL SOLUTION FOR THE IMAGINATION OF ALL AGES

(71) Applicants: Christopher DeBlanco, Mastic Beach, NY (US); Nicholas DeBlanco, Mastic Beach, NY (US)

(72) Inventors: Christopher DeBlanco, Mastic Beach, NY (US); Nicholas DeBlanco, Mastic Beach, NY (US)

(73) Assignees: Christopher DeBlanco, Mastic Beach, NY (US); Nicholas DeBlanco, Mastic Beach, NY (US)

( * ) Notice: Subject to any disclaimer, the term of this patent is extended or adjusted under 35 U.S.C. 154(b) by 50 days.

(21) Appl. No.: 13/690,303

(22) Filed: Nov. 30, 2012

(65) Prior Publication Data

US 2014/0155182 A1 Jun. 5, 2014

(51) Int. Cl.

| | |
|---|---|
| ***A63H 3/52*** | (2006.01) |
| ***E04H 6/00*** | (2006.01) |
| *E04H 1/12* | (2006.01) |

(52) U.S. Cl.

CPC ..... *E04H 6/00* (2013.01)
USPC ..... 446/476; 446/478; 52/79.1; 119/498

(58) Field of Classification Search

USPC ..... 446/476, 478, 479, 120, 121, 85, 105, 446/108–110; 52/79.1, 79.2, 79.3, 79.4, 52/79.5, 79.6; 119/428, 431, 461, 472, 119/474, 478, 498

See application file for complete search history.

(56) References Cited

U.S. PATENT DOCUMENTS

| | | | | |
|---|---|---|---|---|
| 5,121,710 | A * | 6/1992 | Gonzalez | 119/498 |
| 7,581,357 | B2 * | 9/2009 | Richardson et al. | 52/79.5 |
| 7,770,337 | B2 * | 8/2010 | Mower et al. | 52/79.1 |
| 8,069,820 | B2 * | 12/2011 | Anderson et al. | 119/498 |
| 8,578,661 | B1 * | 11/2013 | Braley | 52/71 |
| 8,650,807 | B2 * | 2/2014 | McKimmy et al. | 52/79.9 |
| 2004/0187400 | A1 * | 9/2004 | Anderson et al. | 52/79.1 |

* cited by examiner

*Primary Examiner* — Kien Nguyen
(74) *Attorney, Agent, or Firm* — Limin Wen

(57) ABSTRACT

The present invention relates to a novel personalized children's garage-like playhouse and methods for making and using the same. Such colorful playhouse is made from plastic materials with snap in feature for easy resembling.

11 Claims, 4 Drawing Sheets

MY OWN GARAGE—A FUNCTIONAL SOLUTION FOR THE IMAGINATION OF ALL AGES

FIELD OF THE INVENTION

This invention relates generally to play structures for children. More specifically, the invention relates to a portable plastic garage to store children's toys including toy cars. Such garage is easy to assemble with molded plastic panels in rectangular shape.

BACKGROUND OF THE INVENTION

Prior to the conception and development of the present invention, play structures or playhouses, as are generally well known in the prior art, have consisted of structures made of plastic, wood, or metal, and of tent-like playhouses. Such structures leave little to the imagination and are often bulky, heavy, expensive, and difficult to store, complex to assemble and disassemble, and leave no room for customization and personalization according to a child's likes, interest, and personality.

So far none of the play structures or garage for children provides a place like a toy storage box that enables a child to customize his or her playhouse. Therefore, there exists a need for a child garage which is simple, easy to assemble, and which may be customized or personalized to suit the particular interests, tastes, styles, and the likes of a particular child or group of children. Moreover, there is a need for such a play structure which can be personalized easily by a child who is interested in a particular profession, characterization, or personality.

SUMMARY OF THE INVENTION

The present invention provides a play structure such as a garage for children. Such play structure includes four wall members joined together at predetermined end thereof. Such wall members are manufactured from a predetermined material and have a predetermined size and a predetermined shape. There is at least one door in one of such wall members and there is at least one window in one of such wall members. Also, there are one window and one door installed in the same such wall member. Furthermore, there is a roof attached to the top of the four wall members.

The present invention provides a garage for children and/or a toy storage place which is inexpensive to manufacture and easy to assemble or disassemble. Such children garage can be customized to suit the particular themes, interests, likes, tastes, styles, etc. of a particular child or group of children such as "Fire Department", Police Department", "Gas Station", etc.

DETAILED DESCRIPTION OF THE PREFERRED EMBODIMENTS

The present invention disclosed a children's garage-like playhouse with barn-type doors and methods to resemble such portable playhouse.

Figure 1:
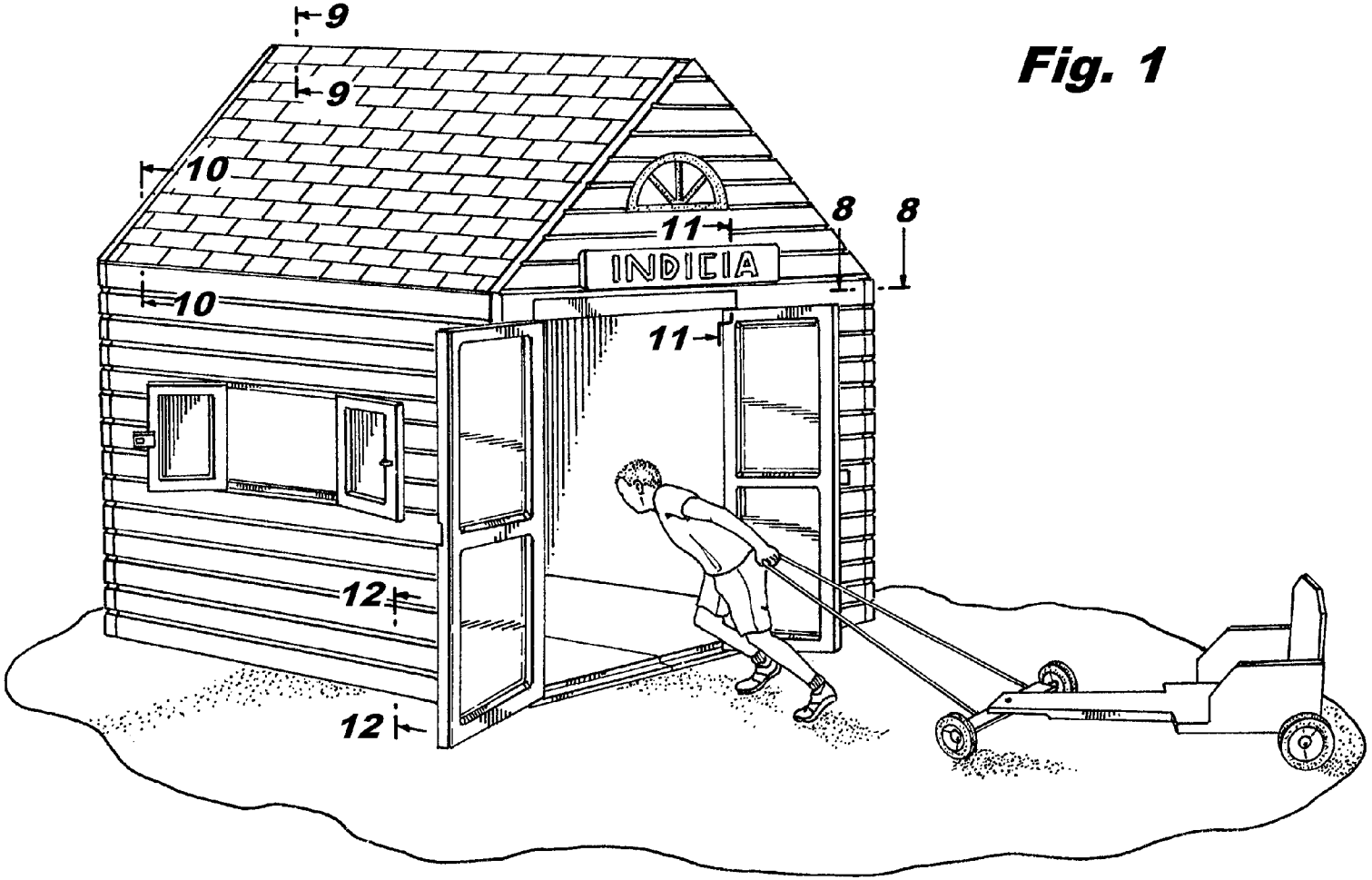
FIG. 1 is a perspective view of a children's garage-like playhouse with barn-type doors.

The present invention (See FIG. 1), called "My Own Garage", is designed and made by plastic panels as the product's major component. Many kinds of plastic materials can be used for this playhouse, particularly ABS (Acrylonitrile-Butadiene-Styrene) which is a type of molded plastic that might be considered the plastic of choice for My Own Garage. For example, ABS manufactured by Borg Warner Chemicals is characterized by its high rigidity and impact strength, excellent abrasion and moisture resistance, as well as resistance to most household chemicals. ABS is easily thermoformed and lends itself remarkably well to mold detail. Such resembled playhouse forms a detached garage which can be used to store many toys (including toy cars) as a large toy box.

Such garage toy box can be manufactured in a rectangular shape with three sizes to accommodate the needs of a large group of consumers.

The first size model, labeled as the low end garage, would be approximately seven feet in length, six feet in width, and six feet in height. The front of the garage would be equipped with a rectangular shaped double door. The door would be about five feet in length and four and a half feet wide.

The second size model, labeled as the middle level garage, would be about ten feet in length, eight feet in width, and six feet in height. The front door would be about five feet in length and six feet in width.

The third size model, labeled as the high end garage, would be about ten feet in length, thirteen feet in width, and six feet in height. This model would be equipped with the same door dimensions (5×6 feet) as the second size model but would be designed with two sets of the same doors along the front.

Figure 2:
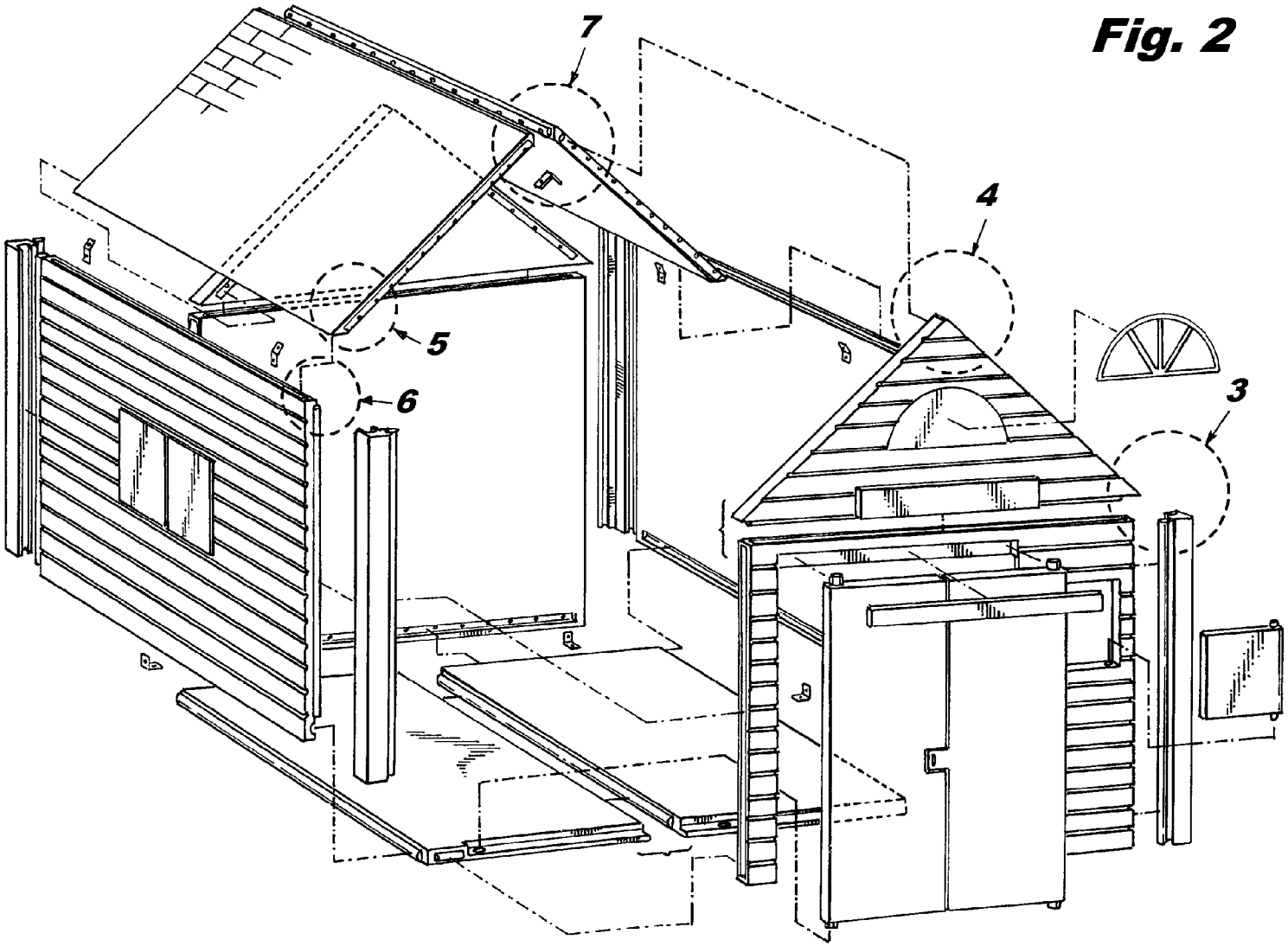
FIG. 2 is a perspective view of a children's garage-like playhouse with detailed assembling features.

Each model would share similar characteristics. The roof of each model is designed with two rectangular shape panels which are held each other by snap in feature and by two Roof Spanners and form a triangular shape with an angle by the same snap in mechanism as a regular roof (See FIG. 2). Also, there are rectangular shaped shingles designed within the same pre-molded roof panels with the same color as the roof panel when they are manufactured through the mold. One side wall of each model is equipped with a rectangular shaped window (formed by two shutters) with two feet in length and two feet in width. The window is consist of two rectangular shape panels or shutters and is placed in the center of the designated side with snap in feature. Also, the window is installed into the side wall by snap-in mechanism since there are Pegs built in the corner of the window panels or shutters and there are four snap-in holes (matching the four Pegs) built in the designated wall. Such window could also be installed in the front of the play structure in addition to the side window (shown in FIG. 2). The front side of each model is also equipped with a name plate above the door on which a child may print or tape (using stickers which are pre-designed alphabet letters) his first name or surname to personalize the play structure (See FIG. 1). Moreover, there is a half moon engraved window with complete details designed on the top of the front side of the play structure (Also in FIG. 1). In FIG. 2, the front side or rear side of the play structure is pre-molded in two pieces unit with rectangular shape bottom (Front Wall panel and Rear Wall Panel) and triangular shape top (Front Wall Panel Upper Portion and Rear Wall Panel Upper Portion) shown in FIG. 2. Additionally, the bottom of the play structure which consists of two rectangular shape panels (Floor Panels), which is resembled together by snap in feature and attached to the bottoms of the walls by the same snap in feature (shown in FIG. 2), is included in the third size model as the high end model and it will be an option for the low end and middle end garages (as mentioned above as first and second size models). All the above panels are connected with snap in feature through Boss/Groove or Bullnose/Groove and related Spanners.

My Own Garage can also be produced to appear to have pre-molded vinyl siding along its sides and within the walls to make the product more realistic. In other words, the vinyl siding and the walls are pre-molded together as one piece panel. Moreover, My Own Garage can be produced in several different color schemes. The variation of colors will allow children to select a garage that resembles the colors of their own home or their own personal preferences.

Figure 3:
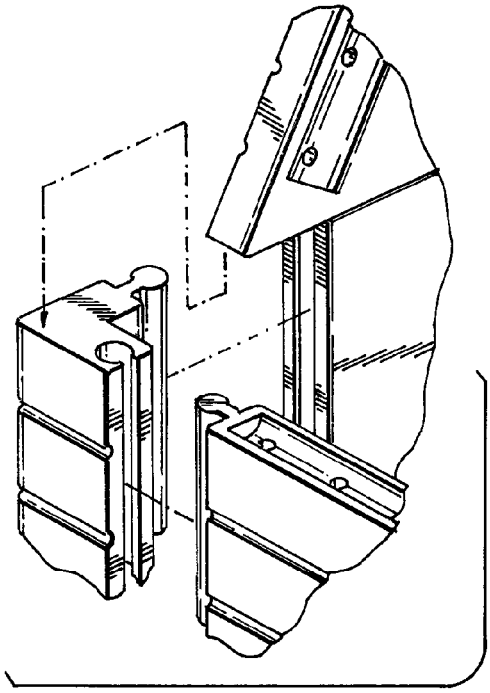
FIG. 3 is a perspective view of how a Corner Extrusion Member is linked with Wall Panels by snap in feature to resemble panels for a children's garage-like playhouse with barn-type doors.
Figure 4:
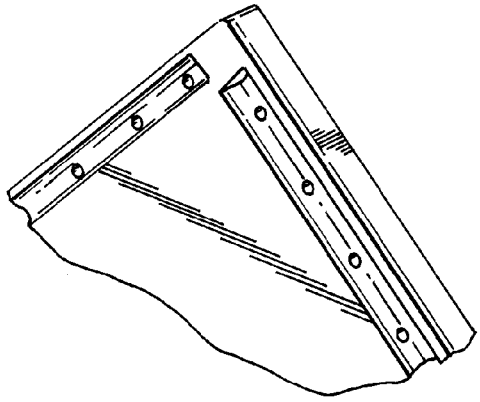
FIG. 4 is an inside sectional view of the Front Wall Panel Upper Portion of a children's garage-like playhouse with barn-type doors.
Figure 6:
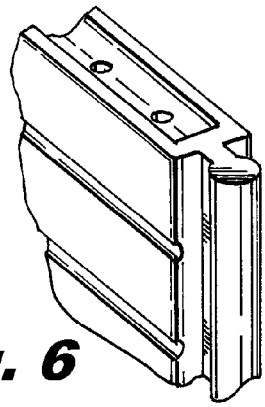
FIG. 6 is an inside sectional view of a corner of a Side Wall Panel of a children's garage-like playhouse with barn-type doors.
Figure 5:
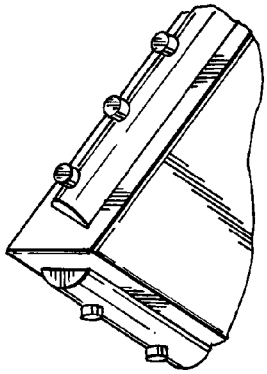
FIG. 5 is an inside sectional view of a corner of a Roof Panel of a children's garage-like playhouse with barn-type doors.
Figure 7:
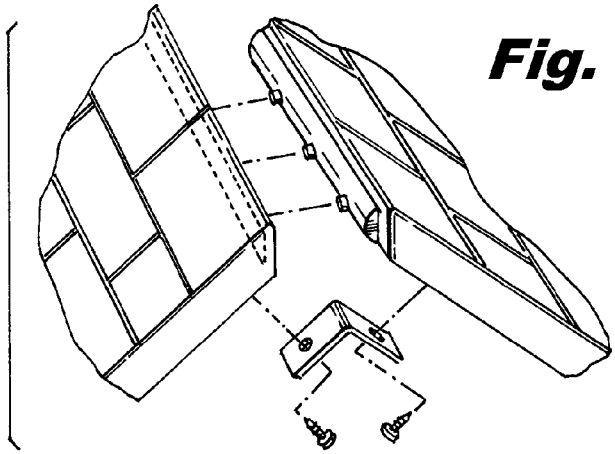
FIG. 7 is a perspective sectional view of how two Roof Panels are assembled together by snap in feature and by Roof Spanners in a children's garage-like playhouse with barn-type doors.
Figure 8:
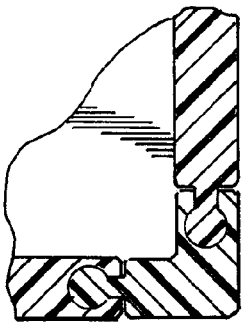
FIG. 8 is a sectional view of a Corner Extrusion Member has been locked with Wall Panels by snap in feature to resemble panels for a children's garage-like playhouse with barn-type doors.
Figure 9:
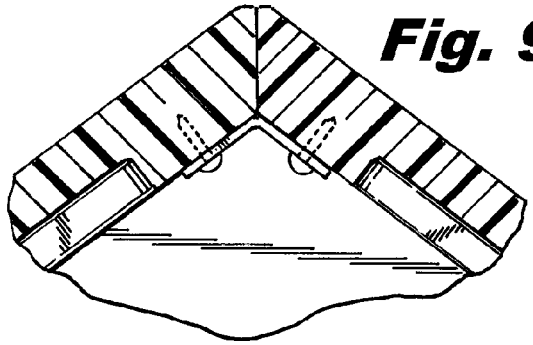
FIG. 9 is a sectional view of two Roof Panels has been locked together by snap in feature and by a Roof Spanner in a children's garage-like playhouse with barn-type doors.
Figure 10:
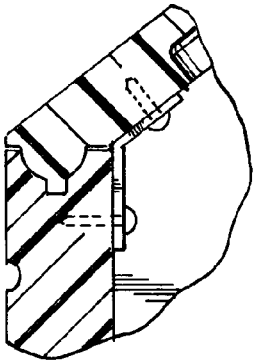
FIG. 10 is a sectional side view of a Roof Panel has been locked with a Side Wall Panel by snap in feature and by a Wall/Roof Spanner in a children's garage-like playhouse with barn-type doors.
Figure 12:
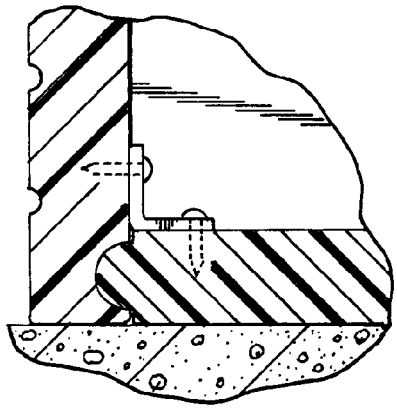
FIG. 12 is a sectional side view of how a Floor Panel has been locked with a Side Wall Panel by snap in feature and by an Angle Spanner in a children's garage-like playhouse with barn-type doors.
Figure 11:
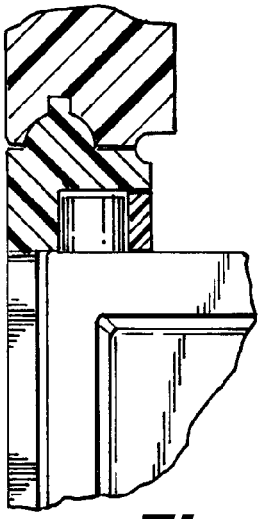
FIG. 11 is a sectional view of how a Door Panel is locked with the Front Door by snap in feature in a children's garage-like playhouse with barn-type doors.
Figure 13:
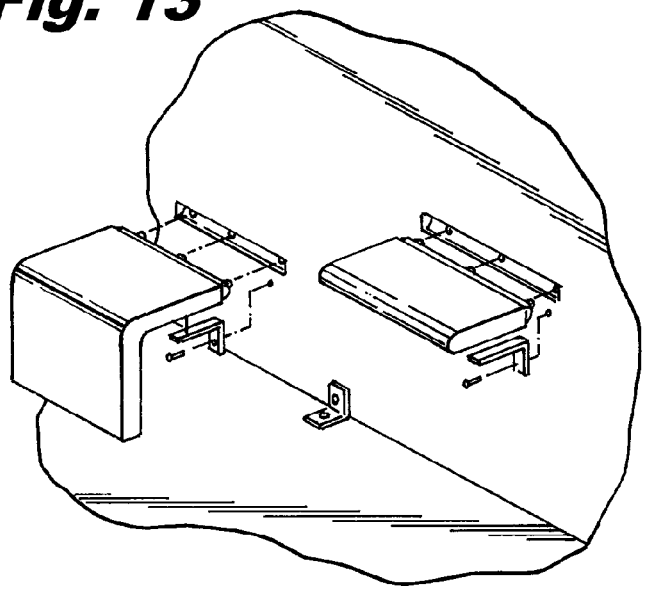
FIG. 13 shows a bench and a shelf which could be added and attached to the interior wall by snap in feature and by spanners.

The method to resemble My Own garage includes putting all the rectangle shaped plastic panels together by snap in feature or mechanism. How the panels fit together among walls, illustrated in FIG. 2, is because of the snap in featured by Corner Extrusion Member, Molded Boss, and Groove. Also, the top and the bottom of the side wall panels will use the same snap in mechanism with Boss/Groove, Bullnose/Groove, and Spanners. The corners are resembled by using the snap in featured by Corner Extrusion Member, Molded Boss, and Groove which is showed in FIG. 3 and the roof is held to the walls together by using with Boss/Groove, Bullnose/Groove, and Wall/Roof Spanners (shown in FIG. 2). Also, two screws per Spanner are needed to secure the roof and the wall. Total four Spanners and eight screws are needed to complete secure the roof to the walls (as shown in FIG. 2). It will only need a total of four plastic Corner Extrusion Members to resemble all the four walls. At the bottom of the garage-like playhouse, two Floor Panels are resembled together by Bullnose/Groove snap in feature and such two Floor Panels are fixed with the bottom of the four walls with same Boss/Groove, Bullnose/Groove, and Angle Spanners (See FIG. 2). For the door installation, two Door Panels form a barn-type door and there are two Upper Pegs and two Lower Pegs built in or molded in the corner of Door Panels for snap in mechanism. Also, there is a Reduced Hinge Area inside the top of the Front Wall Panel to provide space to install the door and there is a Hinge Retaining Member to match the Reduced Hinge Area after installing the door (See FIG. 2).

Such portable plastic garage-like playhouse has the following advantages:

1. Light weight and portable;
2. Resistant to abrasion, moisture, and most household chemicals;
3. No need of a lot of drills/nails or special tools and easy to resemble and dissemble;
4. Can be installed in many locations such as back yard, park, playground, school, etc.;
5. Can be made in different colors with combinations including but not limited to green, blue, yellow, red, brown, purple, orange, black, white, etc.;
6. Personalized with tagged name plate;
7. Standard panels/windows/doors and inexpensive to manufacture;
8. Unique snap in feature with Boss/Groove or Bullnose/Groove without using any of adhesive materials for mounting the panels or the roof;
9. Can be used as a toy storage box or other play place with different themes such as fire department, police department, gas station, etc.;

In summary, the present invention provides a novel, portable and colorful personalized garage-like playhouse, which is inexpensive and easy to manufacture and resemble/dissemble. Such playhouse is also attractive to children and an option to store toy cars without occupying any space in the real garage.

Although the personalized children's garage-like playhouse and the method of resembling the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What is claimed is:

1. A plastic garage-like play structure comprises four wall members, one or two barn-type doors which consists of two same sized rectangular-shaped door panels for each said barn-type door in one of said wall members, one or two rectangular-shaped windows which consists of two same sized rectangular-shaped window panels for each said window, and a roof, wherein said barn-type doors located in one of said wall members and said rectangular-shaped window located in one of said wall members, wherein said roof covered with build-in rectangular-shaped shingles consists of two rectangular-shaped panels which are resembled together by snap-in mechanism and is attached to the top of said wall members and is designed in a triangular shape to cover said wall members from front view, wherein said wall members consist of two rectangular-shaped side walls, one front wall, and one rear wall and two triangular-shaped upper portions on the top of said front wall and on the top of said rear wall of said wall members, wherein there are six spanners are used to hold said roof to the tops of said four wall members, wherein there are four snap-in corner extrusion members with snap-in molded boss and snap-in molded groove are used to hold said four wall members together, wherein there are two upper pegs and two lower pegs in the corners of said door panels for snap in installation of one barn-type door, wherein there is a build-in name plate designed above said barn-type door in the front wall of said play structure, wherein there is a build-in half moon-shaped window decal with complete details designed above said name plate in the front wall of said play structure.

2. The plastic garage-like play structure of claim 1, wherein said wall members, said doors, said windows, said roof, and said corner extrusion members are made from ABS (Acrylonitrile-Butadiene-Styrene) with different colors.

3. The plastic garage-like play structure of claim 1, wherein said snap-in mechanism consists of snap-in molded boss/bullnose and snap-in molded groove or snap-in holes designed inside of said wall members, said roof panels, and said window panels, wherein said snap-in molded boss and snap-in molded groove are designed alone the edges of said wall member and said roof panels, wherein said snap-in holes are designed at the four corners of the window area within said wall member where is used to install said window panels and said snap-in pegs are designed at the corners of said window panels which are used to match said snap-in holes at the four corners of the window area.

4. The plastic garage-like play structure of claim 1, wherein there is one window and one door or two doors installed within the same said wall member in the front of said garage-like play structure.

5. The plastic garage-like play structure of claim 1, wherein said wall member is approximately seven feet in length, six feet in width, and six feet in height, wherein said barn-type door is about five feet in length and four and a half feet in width.

6. The plastic garage-like play structure of claim 1, wherein said wall member is approximately ten feet in length, six feet in height, and eight feet in width, wherein said barn-type door is about five feet in length and six feet in width.

7. The plastic garage-like play structure of claim 1, wherein said wall member is approximately ten feet in length, six feet in height, and thirteen feet in width, wherein there are two said barn-type doors of each is about five feet in length and six feet in width.

8. The plastic garage-like play structure of claim 1, wherein said rectangular-shaped window is about two feet in length and two feet in width.

9. The plastic garage-like play structure of claim 1, wherein said spanner consists of L-shaped body unit and two holes at each end of said L-shaped body unit, wherein said two holes at each end of said L-shaped body unit are used to insert two metal screws which have a big cap at one end of said metal screw.

10. The plastic garage-like play structure of claim 1, wherein there is a bottom member connected with all said wall members by said snap-in mechanism, wherein said bottom member consists of two rectangular-shaped bottom panels which connected each other by snap-in mechanism with bullnose and groove.

11. A method of resembling said plastic garage-like play structure of claim 1 by snapping in all said roof panels, said wall members, said window panels and by securing said roof into the tops of said wall members with said spanners on which said metal screws are inserted into said wall members.

* * * * *